US009842292B1

(12) United States Patent
Miller

(10) Patent No.: US 9,842,292 B1
(45) Date of Patent: Dec. 12, 2017

(54) RECEPTACLE WITH CAN COUNTER

(71) Applicant: Margaret Miller, Devon (CA)

(72) Inventor: Margaret Miller, Devon (CA)

( * ) Notice: Subject to any disclaimer, the term of this patent is extended or adjusted under 35 U.S.C. 154(b) by 581 days.

(21) Appl. No.: 13/755,508

(22) Filed: Jan. 31, 2013

Related U.S. Application Data

(60) Provisional application No. 61/592,882, filed on Jan. 31, 2012.

(51) Int. Cl.
*G06M 1/00* (2006.01)

(52) U.S. Cl.
CPC ..... *G06M 1/00* (2013.01)

(58) Field of Classification Search
CPC ..... G06M 1/083; G06M 1/086; G06M 1/00; G06M 1/02; G06M 1/22; G06M 1/86; G06M 1/83; G07F 7/00; G07F 7/06; G07F 7/0609; B65F 2210/124; B65F 2240/112; B65F 2240/1123; B65F 2240/1126; B65F 2240/12
See application file for complete search history.

(56) References Cited

U.S. PATENT DOCUMENTS 3,721,806 A * 3/1973 Stothart ..... 235/61 PD
3,977,599 A * 8/1976 Bud et al. ..... 235/144 HC
4,050,604 A * 9/1977 Flanders ..... B65D 7/24 206/599
4,147,100 A 4/1979 Dykstra
4,293,765 A * 10/1981 Kashiwagi ..... 235/144 R
4,472,819 A 9/1984 Constantino
4,499,370 A * 2/1985 Nishiuchi ..... 235/144 HC
4,545,062 A 10/1985 Pray
4,603,791 A 8/1986 Spierer et al.
4,742,339 A * 5/1988 Baziuk ..... 340/568.1
4,845,886 A * 7/1989 Robinson ..... 43/55
4,971,244 A * 11/1990 Friedman ..... D06F 95/002 232/1 B
5,090,031 A 2/1992 Pyne et al.
5,224,131 A 6/1993 Searfoss
5,294,913 A * 3/1994 Mower ..... A63B 24/0021 116/222
5,340,179 A * 8/1994 Rubin ..... A63B 47/02 294/19.2
D364,567 S * 11/1995 Dancel et al. ..... D9/436
5,533,079 A * 7/1996 Colburn ..... G06M 7/04 377/6
5,576,621 A 11/1996 Clements
5,887,696 A 3/1999 Goetz
5,941,016 A * 8/1999 Welcher ..... 43/55
6,050,485 A * 4/2000 Brito ..... 235/91 R
7,096,780 B1 8/2006 Hawkins
(Continued)

*Primary Examiner* — Thomas J Hiltunen
(74) *Attorney, Agent, or Firm* — Robert C. Montgomery; Montgomery Patent & Design, L.P.

(57) ABSTRACT

A receptacle that counts empty beverage cans for recycling frames an opening of a waste receptacle such as a trash can or recycling bin. The apparatus includes an actuation arm located inside the opening. The arm is pressed to the side whenever a can is inserted into the waste receptacle. The arm is connected to a mechanical counter located on an outside of a lid. After each can is added, the counter increments by one (1) to indicate the number of beverage cans inside of the container. The counter can be reset when the container is emptied or the bag changed.

13 Claims, 6 Drawing Sheets

(56) References Cited

U.S. PATENT DOCUMENTS

| | | | | |
|---|---|---|---|---|
| D532,860 | S * | 11/2006 | Richardson et al. | D22/134 |
| 7,464,498 | B2 * | 12/2008 | Lester | A01K 97/20 43/55 |
| 8,044,337 | B2 * | 10/2011 | Duszynski | 250/221 |
| 8,820,566 | B2 * | 9/2014 | Ude | B65F 1/1607 220/254.8 |
| 2004/0000904 | A1 | 1/2004 | Cotter | |
| 2008/0230542 | A1 * | 9/2008 | Thielke et al. | 220/212 |
| 2013/0082114 | A1 * | 4/2013 | Sebastiano | 235/61 R |
| 2015/0161504 | A1 * | 6/2015 | Scott | G06M 1/086 116/284 |

* cited by examiner

RECEPTACLE WITH CAN COUNTER

RELATED APPLICATIONS

The present invention was first described in U. S. Patent Provisional No. 61/592,882 filed on Jan. 31, 2012 the entire disclosures of which are incorporated herein by reference.

FIELD OF THE INVENTION

The present invention to a lid for a waste container having a counting device thereon, where the counting device is configured to incrementally tally an item deposited in the waste container when contacted.

BACKGROUND OF THE INVENTION

With society's increasing awareness of the world's dwindling supply of natural resources and overflowing landfills, many communities are providing and even mandating recycling services to its residents. The benefits of these efforts have already begun to be seen and will continue to be realized in the future. However, as with most beneficial programs, these efforts are accompanied by some burdens. Perhaps the biggest burden is "special requirements" that accompany the collection of recycled materials. This may include presorting by the consumer, the use of special bags and/or containers, or the like.

One (1) additional requirement, for the collection of used beverage cans, is that they are packaged in bags with a certain quantity, especially for monetary rebates. Thus the user is typically forced to wait until more than enough cans are collected, and then recount the correct amount into a separate bag or container. This not only takes time and increases fuss, but also forces the consumer to wait longer than necessary to collect any recycling credit. Can and bottle counter apparatuses do exist but none are conducive for personal use in one's home, or, if they are, they are not configured to be retro-fitted onto any standard trash or recycling receptacle.

U.S. Pat. No. 4,472,819 shows a can differentiator and counter reverse-vending machine. This machine is placed inside local convenience and food stores for consumers to bring empty cans to and deposit into the machine. The machine determines the type of metal of each can, counts the number of cans deposited, and tenders payment to the depositor.

U.S. Pat. No. 4,545,062 shows an empty can counter and limiter device that is placed on top of a standard refuse receptacle by taking the place of the lid of the receptacle. Such a device can only be employed on receptacles with openings that match the size of the device because the device serves as the lid. The counting mechanism comprises of a photosensor and electrical circuit interface.

U.S. Pat. No. 4,603,791 shows a specially designed container and refuse bag that works in concert to collect and count bottles and cans to be recycled.

U.S. Pat. No. 5,090,031 shows a can counting machine that is to be employed by recycling and processing scrap yards to receive large quantities of various metal cans.

U.S. Pat. No. 5,224,131 shows a counting apparatus that is formed into a lid and placed upon bins to count the number of items deposited into the bin. Such a device can only be employed on receptacles with openings that match the size of the device because the device serves as the lid.

The present invention affords a user the ability to retro-fit the device to virtually any container having a lid. The patents cited are counting apparatuses for cans and other objects, and are designed for practically similar functions; however, none of the cited patents allows a user to retro-fit the device on virtually any container. U.S. Pat. Nos. 4,545,062 and 5,224,131 are devices that also serve as a lid so these can only be employed on similar sized containers. U.S. Pat. Nos. 4,603,791 and 5,090,031 are specially designed containers and machines that do not exhibit any retro-fitting capabilities.

SUMMARY OF THE INVENTION

The present invention relates to a counter device that tallies the number of empty cans, or other similar objects, deposited into a receptacle, which can be employed with most standard trash and recycling receptacles. The device is designed to be placed on top and fitted onto a lid of a standard trash or recycling bin. The user cuts a hole in the lid and fits the device on top, aligning a receiving aperture of the device with the opening created by the cut. The device comprises of an external collar forming a frame, a pivoting activation arm located inside an opening of the frame, a counting apparatus, and a fastener mechanism.

The frame further comprises a housing fabricated from material exhibiting suitable properties of rigidity and durability, and is configured to form enveloping walls extending downward to define a hollow interior channel with a receiving aperture granting access to the interior channel. A user deposits an object through the receiving aperture, and, as it falls, it leads into the interior channel, then into a cavity portion of the trash or recycling receptacle.

The housing is equipped with fasteners to fasten it to a lid portion of a trash or recycling receptacle. The pivot actuation arm is located at an inner surface of the enveloping wall portion. The pivot actuation arm is connected, via an indexing shaft to the counting apparatus, which is located at an exterior side wall of the housing.

The counting apparatus is preferably a digital mechanical counter with a reset feature. As an object is deposited through the receiving aperture, the pivoting actuation arm moves in response to the object, which activates the counting apparatus and begins a tally in increments of one (1) due to a ratchet mechanism interfaced with the engagement tine of the indexing shaft. A beneficial feature is for the counter apparatus to be provided with a counter reset to zero-out the counter tally.

A user first obtained a receptacle bin equipped with an accompanying lid, such as any standard trash or recycling bins found in local stores. A hole is cut in the lid that is substantially the size of the receiving aperture of the device. The device is positioned over the lid opening such that the channel and bottom opening are aligned with the lid opening. The device is then attached by a plurality mechanical fasteners. By resetting the counting device to a zero (0) count, the device is ready for use. Each time an object is inserted into a top opening of the receptacle, the pivoting actuation arm is activated thereby causing the arm to rotate the indexing shaft and advance the count by one (1) unit. The device is used over the course of days or weeks until the desired number is registered on the counting device. When the container is emptied, the counter is reset to zero (0).

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
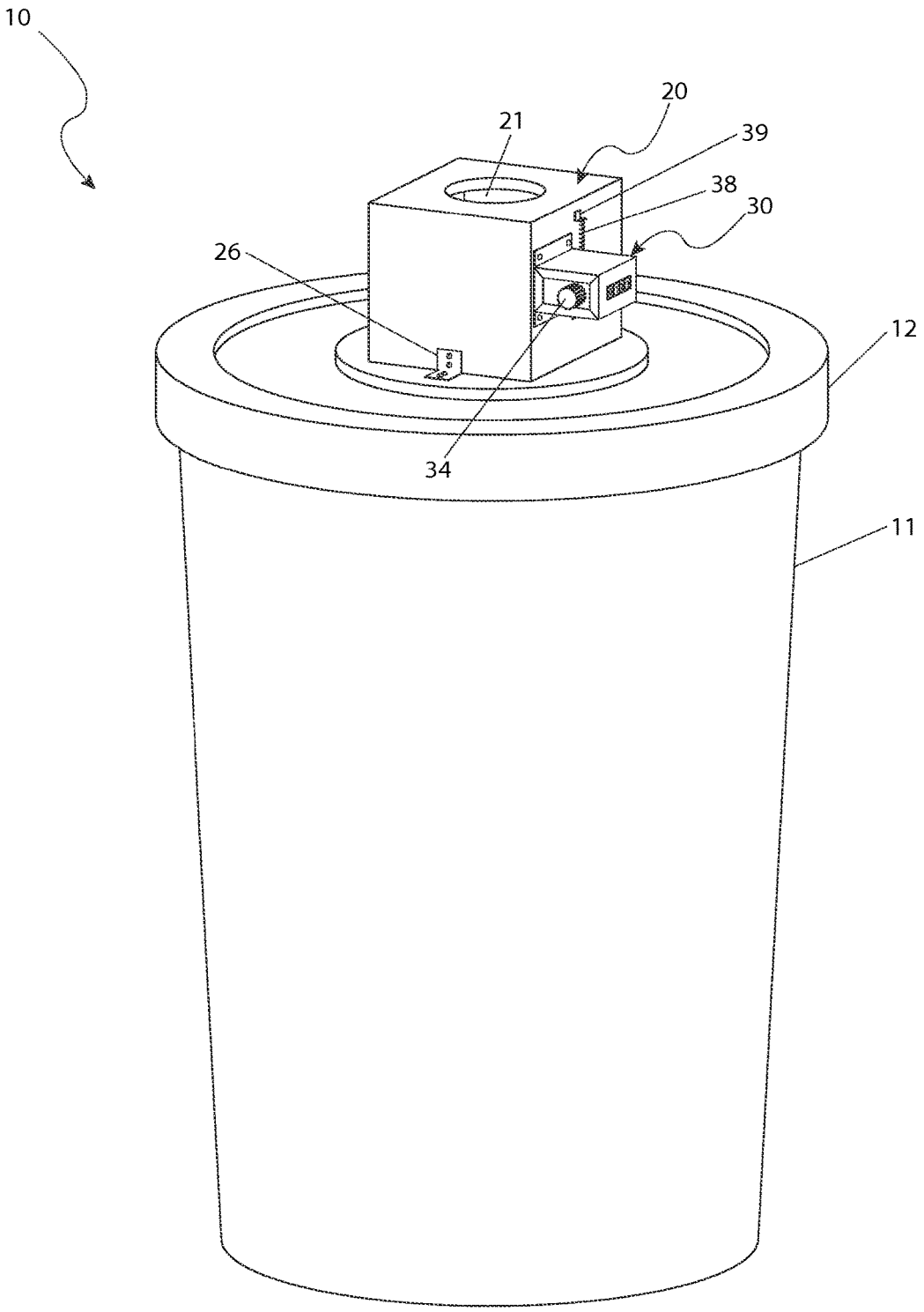
FIG. 1 is a perspective view of a receptacle with counter device 10 depicted in use with a waste container 11 in accordance to the preferred embodiment of the present invention.

10 receptacle with counter device
11 waste container
12 lid
13 can
14 lid opening
20 receptacle housing
21 channel
22 sidewall
23 top opening
24 bottom opening
25 access aperture
26 fastener
30 counting device
31 indexing shaft
32 actuation arm
33 contact point
34 counter reset
35 digit wheel
36 ratchet gear
37 engagement tine
38 return spring
39 bracket
40 alternate lid

DETAILED DESCRIPTION OF THE PREFERRED EMBODIMENT

Figure 6:
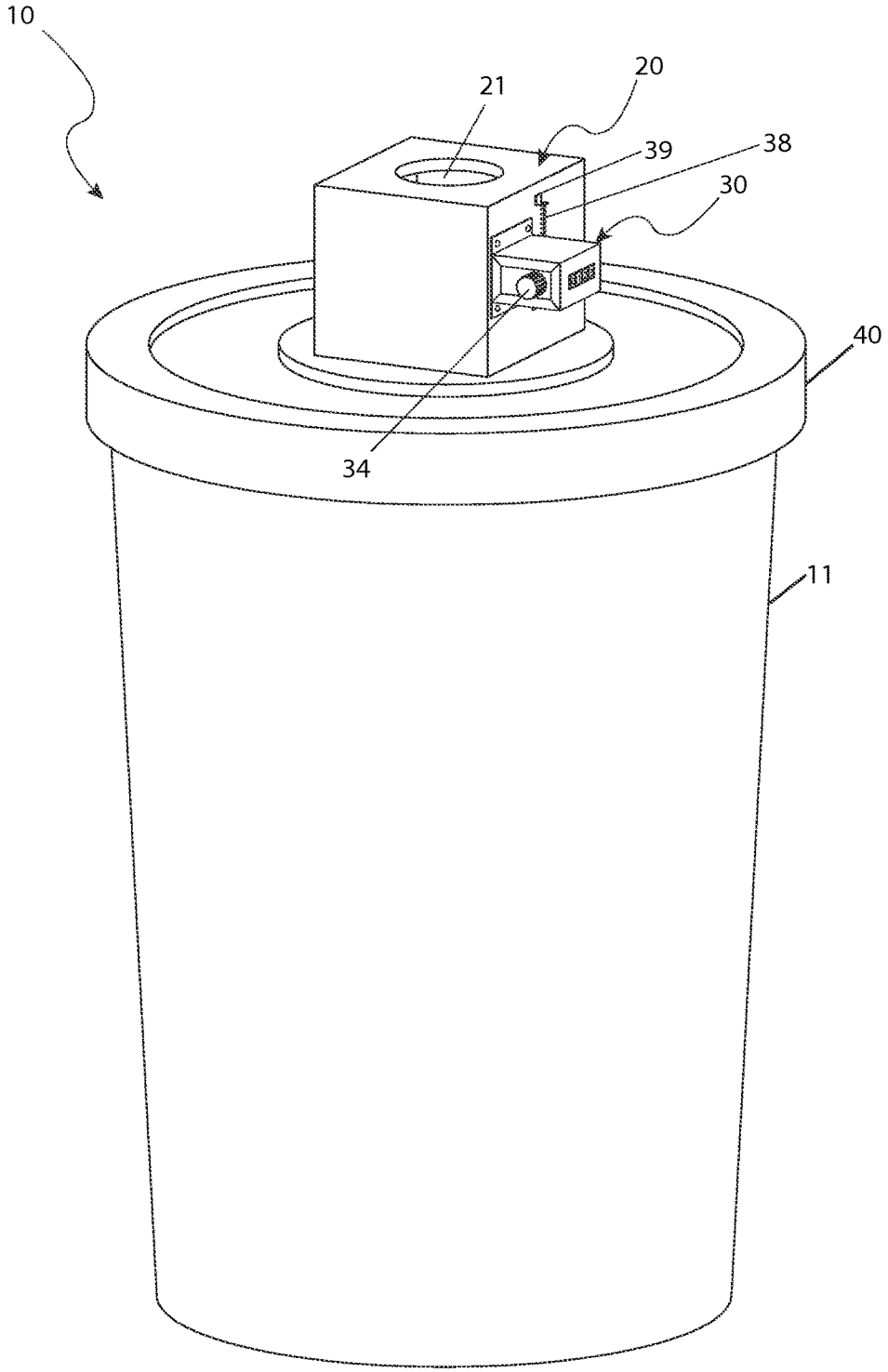

The best mode for carrying out the invention is presented in terms of its preferred embodiment, herein depicted within FIGS. 1 through 4 and in FIG. 6 as an alternate embodiment. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a receptacle with a counting device (herein referred to as the "device") 10, which provides a means to mechanically count, and keep track of, the number of items placed into the container 11 to which the receptacle 10 is attached. As used herein, the term waste container 11 refers to any waste container, refuse canister, trash can, recycling container or other similar receptacle. This type of waste container 11 typically includes a container body for holding amounts of waste prior to pick up or disposal. The container 11 can include wheels attached to the container body or have no wheels. The container 11 can be provided with a removable lid 12 or an attached, hinged lid 11 that covers an interior of the container body. The waste container 11 can be used with out without a disposable can liner.

In certain embodiments, the device 10 is attached to the lid 12 of an existing waste container 11 with slight modifications. In certain embodiments, the device 10 is integral to the lid 40 of the container 11 forming a unitary device as shown in FIG. 6. Additionally, it can be appreciated that while the device 10 is particularly beneficial in the counting of cans 13, bottles, and similar recyclable materials; it can be used for counting objects of various different types. For the purpose of illustrating the preferred embodiments, the device 10 is described as being a can counter used in association with a recycling container 11.

Referring now to FIG. 1, a perspective view of the device 10 mounted to the lid 12 of a waste container 11 in accordance to the preferred embodiment of the present invention, is disclosed. The device 10 is comprised of a receptacle housing 20 and a counting device 30 mounted to the exterior of the housing 20 for incrementally counting the number of cans 13 inserted into the housing 20 for deposit within the container 11. In the illustrated embodiment, the housing 20 has a generally square shape having four (4) sidewalls 22 connected along vertical edges defining a hollow interior channel 21. It can be appreciated that the housing 20 can have various shapes, such as round or hexagonal yet still defining an internal hollow channel 21 extending entirely though the housing 20 and as such should not be viewed as a limiting factor of the device 10. In the illustrated embodiment, the housing 20 is approximately four inches (4 in.) long, four inches (4 in.) wide, and four inches (4 in.) high. However it can be appreciated that the dimensions of the housing can vary without deviating from the scope and purpose of the device 10. The housing 20 is preferably fabricated from a rigid, durable polymer in a typical thermoforming process, and includes a top opening 23 which provides access to the interior channel 21, and a bottom opening 24 at the lower end of the channel 21 as can be seen in FIG. 3. The top opening 23, the channel 21, and the bottom opening 24 provide a passage for the can 13 to pass through a lid opening 14 in the lid 12 for deposit into the container 11. The lid opening 14 is approximately equivalent in size and shape to the bottom opening 24 of the housing 20. The housing 20 is fastened to the top surface of the lid 12 by at least one (1) fastener 26, such as an angle clip with threaded fasteners, as best seen in FIG. 2.

Figure 2:
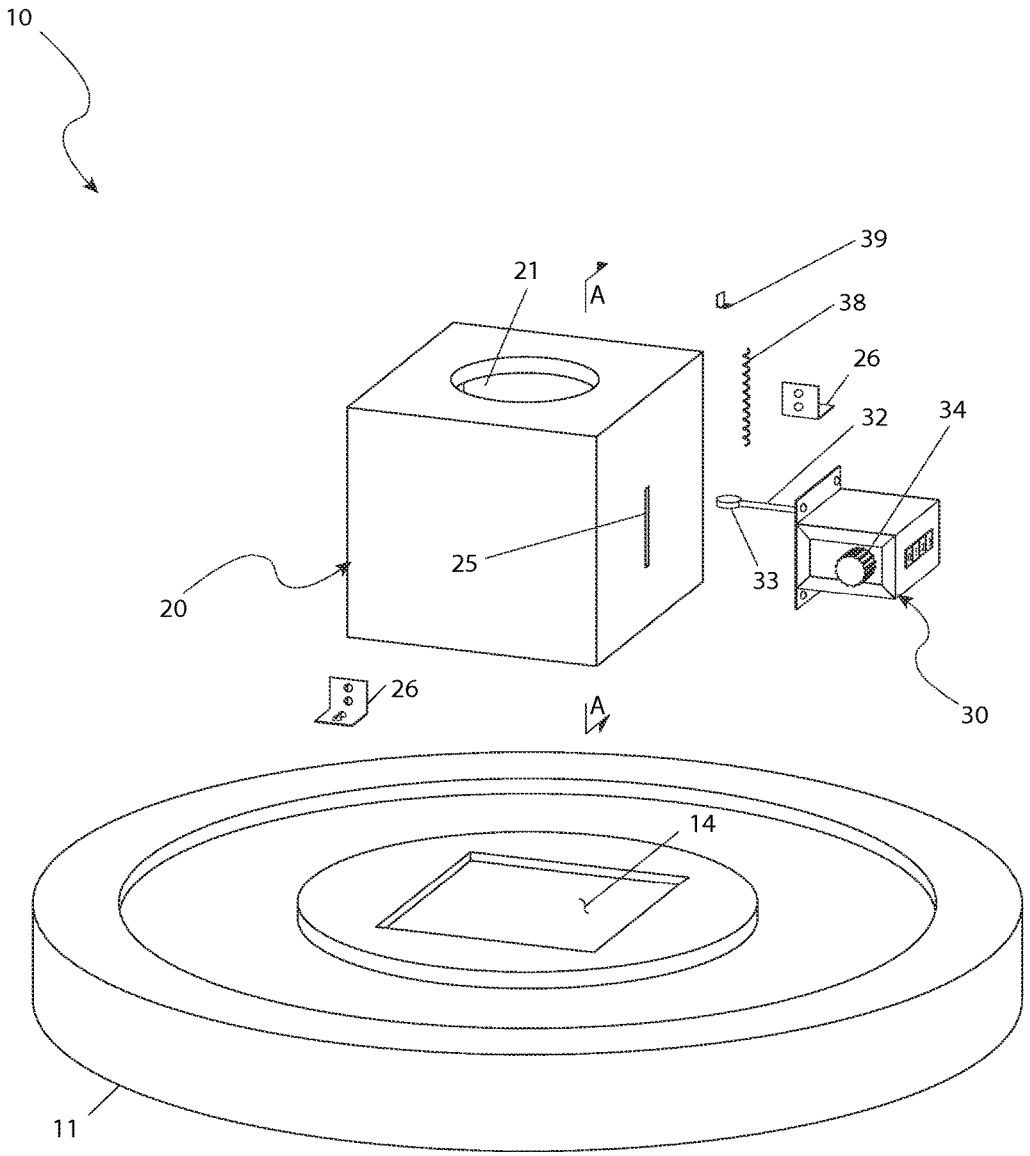
FIG. 2 is an exploded perspective view of the receptacle with counter device 10 depicted with a waste container lid 12 in accordance to the preferred embodiment of the present invention.
Figure 3:
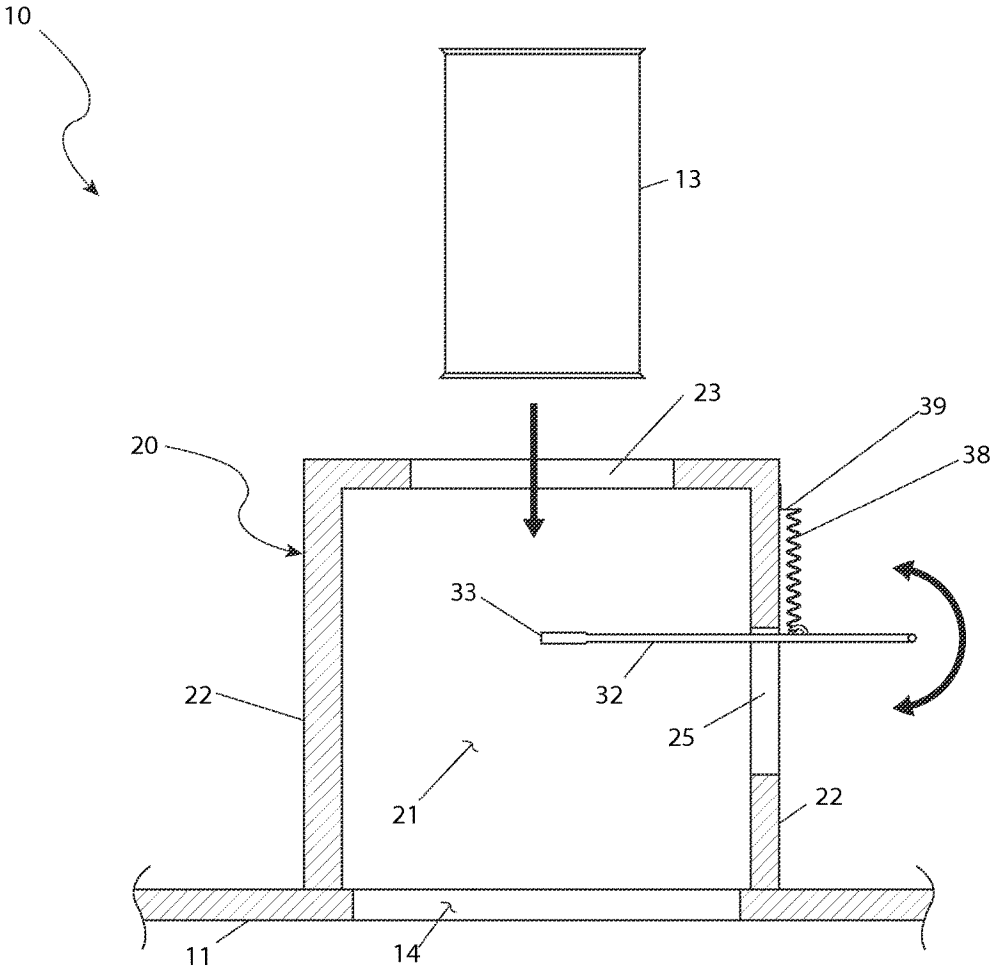
FIG. 3 is a section view along the line A-A in FIG. 2 of the receptacle with counter device 10 showing a can 13 being inserted therein in accordance to the preferred embodiment of the present invention.
Figure 5:
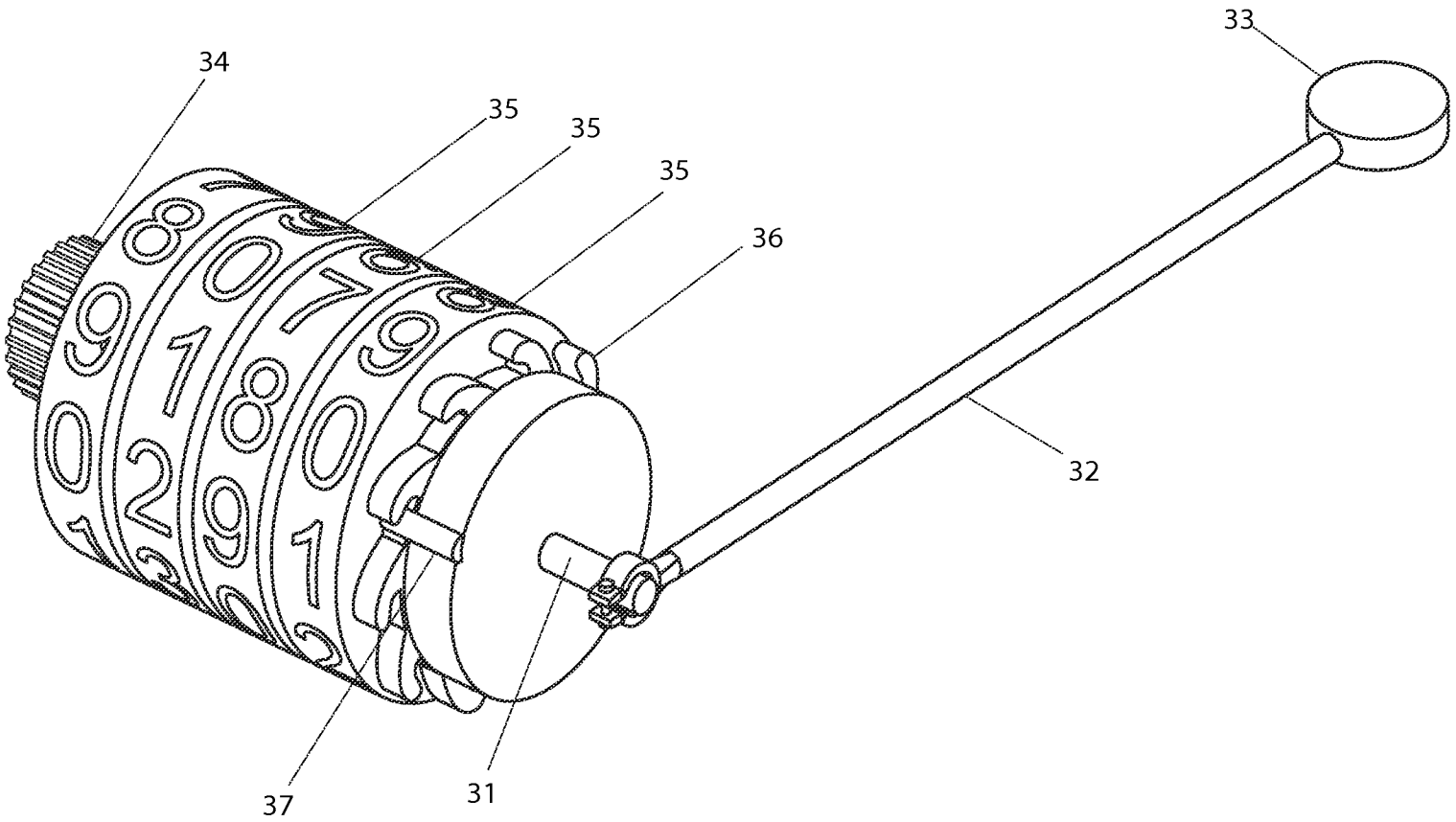
FIG. 5 is a close-up view of the actuation arm 32, plurality of digit wheels 35, and ratchet 36 assembly in accordance to the preferred embodiment of the present invention; and, FIG. 6 is a perspective view of a receptacle lid 40 with an integral counter device 10 depicted in use with a waste container 11 in accordance with an alternate embodiment of the present invention.

Referring now to FIG. 2, an exploded perspective view of the receptacle with counter device 10 depicted with a waste container lid 12 and FIG. 5, a close-up view of the actuation arm 32, plurality of digit wheels 35, and ratchet 36 assembly, according to the preferred embodiment of the present invention, is disclosed. The housing 20 includes an access aperture 25 disposed in a sidewall to accommodate the motion of the actuation arm 32 of the counting device 30. The counting device 30 is affixed to the exterior of the side wall of the housing 20 in proximity to the access aperture 25 with threaded fasteners or metal rivets. The actuation arm 32 has a proximal end and is attached to the indexing shaft 31 of the counting device 30 and projects through the access aperture 25 and into the channel 21 to terminate at a distal end. The distal end is a plate defining a contact point 33 that resides generally subjacent to the center of the top opening 23 to ensure contact with a can 13 as the can 13 passes through the receptacle housing 20. The counting device 30 is preferably a Dayton, model 6X158, five-digit mechanical counter with a reset feature, or similar. Each time the actuation arm 32 moves downwardly in response to a can 13 passing through the channel 21, the counter tally is advanced by one (1) unit through a ratchet 36 operably controlled by the indexing shaft 31. Since the digit wheels 35 are connected through the ratchet 36, the digit wheels 35 do not reverse in response to the actuation arm 32 being returned to the up position by the action of an included spring 38 and thus keep a running tally of the number of cans 13 deposited within the container 12. The counting device 30 also includes a counter reset 34 which can return all of the digit wheels 35 to a zeroed position.

Figure 4:
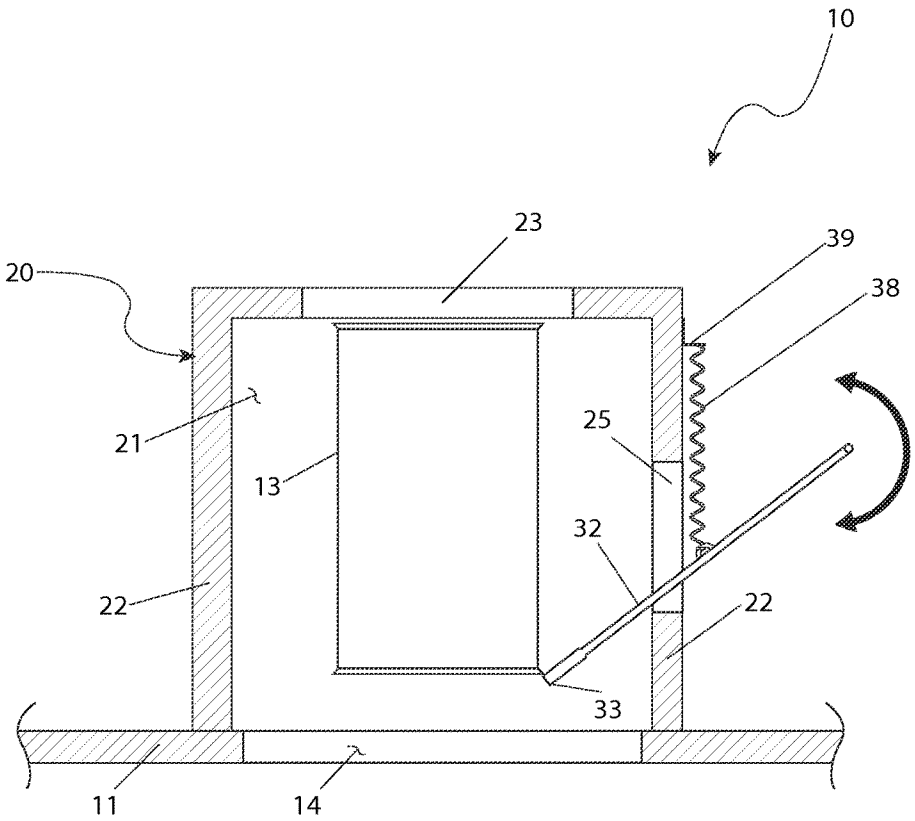
FIG. 4 is a section view along the line A-A in FIG. 2 of the receptacle with counter device 10 showing a can 13 being counted in accordance to the preferred embodiment of the present invention.

Referring now to FIGS. 3 and 4, section views along the line A-A in FIG. 2 of the receptacle lid 12 with counting device 30 showing a can 13 being counted in accordance to the preferred embodiment of the present invention, is presented. The can 13 is inserted into the top opening 23 and continues through the channel 21 formed by the sidewalls 22 of the receptacle housing 20, eventually depressing the contact point 33 of the actuation arm 32 of the counting device. As the contact point 33 is encountered, the actuation arm 32 travels downward to operably rotate the index shaft 31, where an engagement tine 37 of a drum portion of the indexing shaft 31 rotates the ratchet 36 and thus the digit wheels 35, thereby causing the counting mechanism 30 to be advanced one (1) count. The digit wheels 35 each have a plurality of incremental numerals disposed thereon. The can 13 continues to progress through the channel 21 and pass by the actuation arm 32 which can then be returned to the horizontal orientation by the return spring 38. The return spring 38 is mounted via a bracket 39 to the exterior of the housing 20 adjacent to the counting mechanism 30. The can 13 finally passes through the bottom opening 24 of the receptacle housing 20 and the lid opening 14 to be deposited in the container 11.

The preferred embodiment of the present invention can be utilized by the common user in a simple and straight forward manner with little or no training. After initial purchase or acquisition of the device 10, it would be installed as indicated in FIGS. 1 and 2.

The method of installing and utilizing the device 10 may be achieved by performing the following steps: acquiring a model of the device 10 having the desired operating options; cutting a lid opening 14 in the lid 12; positioning the housing 20 over the lid opening 14 such that the channel 21 and bottom opening 24 are aligned with the lid opening 14; attaching the housing 20 to the lid 12 by a plurality of brackets 26 and mechanical fasteners; installing the lid 12 onto the container 11; resetting the counting device 30 via the counter reset 34 to zero (00000); and inserting a can 13 into the top opening 23 of the receptacle housing 20 and having the can 13 pass through the channel 21 of the receptacle housing 20 to depress the contact point 33 of the actuation arm 32 and thereby cause the actuation arm 32 to rotate the indexing shaft 31, to which the proximal end of the actuation arm 32 is attached, to advance the count by one (1) unit according to the preferred embodiment, one at a time, over the course of days or weeks, until the desired number is registered on the counting device 30.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A waste container, comprising:

a container body comprising a housing structure;

a lid on said container body, said lid having a lid aperture; and, a receptacle receiver superjacent said lid aperture, said receptacle receiver having a sidewall with an access aperture that leads to a channel having a top opening and which is disposed over said lid aperture; and, a counting device affixed to said sidewall, said counting device comprising:

an actuation arm having a proximal end and a distal end, said actuation arm extending through said access aperture such that said distal end terminates within said channel and said proximal end extends outside of said receptacle receiver;

an indexing shaft directly attached to said actuation arm proximal end;

a counting mechanism operably connected to said indexing shaft;

a counter reset operably connected to said counting mechanism;

a contact plate attached to said actuation arm distal end; and, a spring external to said receptacle receiver, said spring biasing said actuation arm upward;

wherein said receptacle receiver is adapted to receive an item deposited therein;

wherein said counting device counts when an item deposited in said receptacle receiver depresses said contact plate;

wherein said counting device displays said count as an incremental digit on said counting mechanism and stores said count; and, wherein said counter reset zeroes said count.

2. The container of claim 1, wherein said counting mechanism further comprises:

a ratchet in mechanical communication with an engagement tine on a drum portion of said indexing shaft; and, a plurality of digit wheels in mechanical communication with said ratchet;

wherein said indexing shaft advances said plurality of digit wheels to said advanced position via said ratchet; and, wherein each of said plurality of digit wheels comprises incremental numerals disposed thereon, said numerals corresponding to said count.

3. The receptacle of claim 2, wherein said lid is removably attached to an upper perimeter edge of said housing structure.

4. The container of claim 3, wherein said receptacle receiver is fastened to a top surface of said lid by at least one angle clip, configured to receive a fastener.

5. The container of claim 3, wherein said receptacle receiver and said lid are a unitary structure.

6. The container of claim 2, wherein said lid is hingedly attached to an upper perimeter edge of said housing structure.

7. The container of claim 6, wherein said receptacle receiver is fastened to a top surface of said lid by at least one angle clip, configured to receive a fastener.

8. The container of claim 6, wherein said receptacle receiver and said lid are a unitary structure.

9. A lid for a waste container, comprising:

a lid aperture configured to be in fluid communication with an interior of said waste container; and, a receptacle receiver removably attached to said lid, said receptacle receiver having a sidewall with an access aperture that leads to an internal channel having a top opening and which is disposed over said lid aperture and a counting device affixed to said sidewall about said access aperture, an actuation arm having a proximal end and a distal end, said actuation arm linearly extending inwardly through said access aperture such that said distal end terminates in said channel, and a contact plate attached to said actuation arm distal end;

wherein said counting device further comprises:

an indexing shaft directly attached to said actuation arm proximal end;

a spring biasing said actuation arm such that said contact plate resides within said channel:

a counting mechanism operably connected to said indexing shaft; and, a counter reset operably connected to said counting mechanism;

wherein said lid is adapted to attach to a waste container;

wherein said receptacle receiver is adapted to receive an item deposited therein;

wherein said counting device counts when a deposited item depresses said contact plate;

wherein said counting device displays said count as an incremental digit on said counting mechanism and stores said count; and, wherein said counter reset zeroes said count.

10. The lid of claim 9, wherein said counting mechanism further comprises:

a ratchet in mechanical communication with an engagement tine on a drum portion of said indexing shaft; and, a plurality of digit wheels in mechanical communication with said ratchet;

wherein said indexing shaft advances said plurality of digit wheels to said advanced position via said ratchet; and, wherein each of said plurality of digit wheels comprises incremental numerals disposed thereon, said numerals corresponding to said count.

11. The lid of claim 9, wherein said receptacle receiver is fastened to a top surface of said lid by at least one angle clip, configured to receive a fastener.

12. A lid for a waste container, comprising:

a lid aperture disposed over an interior of said waste container; and, an upwardly extending receptacle receiver forming an integral part of the lid, the receptacle receiver forming an internal channel between an upper aperture and a lower aperture, said receptacle receiver having a sidewall with an access aperture and a counting device affixed to said sidewall and having an actuation arm having a proximal end and a distal end, said actuation arm extending through said access aperture and into said channel, said receptacle receiver further having a contact plate attached to said actuation arm distal end;

wherein said counting device further comprises:

an indexing shaft directly attached to said actuation arm proximal end;

a spring biasing said actuation arm upward;

a counting mechanism operably connected to said indexing shaft; and, a counter reset operably connected to said counting mechanism;

wherein said lid is adapted to cover said waste container;

wherein said receptacle receiver is adapted to receive an item deposited therein;

wherein said counting device counts when said item deposited within said actuation arm contacts said contact plate;

wherein said counting device displays a count as an incremental digit on said counting mechanism and stores said count; and wherein said counter reset zeroes said count.

13. The lid of claim 12, wherein said counting mechanism further comprises:

a ratchet in mechanical communication with an engagement tine on a drum portion of said indexing shaft; and, a plurality of digit wheels in mechanical communication with said ratchet;

wherein said indexing shaft advances said plurality of digit wheels to said advanced position via said ratchet; and, wherein each of said plurality of digit wheels comprises incremental numerals disposed thereon, said numerals corresponding to said count.

* * * * *